US010622743B2

(12) United States Patent
Kimura et al.

(10) Patent No.: US 10,622,743 B2
(45) Date of Patent: Apr. 14, 2020

(54) TERMINAL MODULE WITH A CONDUCTIVE OBLIQUELY WOUND COIL SPRING HELD AGAINST AN ELECTRICAL CONTACT MEMBER AND CONNECTOR HAVING SUCH A TERMINAL MODULE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Akio Kimura, Mie (JP); Seido Nishijima, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/314,741

(22) PCT Filed: Jun. 20, 2017

(86) PCT No.: PCT/JP2017/022656
§ 371 (c)(1),
(2) Date: Jan. 2, 2019

(87) PCT Pub. No.: WO2018/008384
PCT Pub. Date: Jan. 11, 2018

(65) Prior Publication Data

US 2019/0245293 A1 Aug. 8, 2019

(30) Foreign Application Priority Data

Jul. 6, 2016 (JP) ..... 2016-134258

(51) Int. Cl.
*H01R 13/24* (2006.01)
*H01R 13/518* (2006.01)
(Continued)

(52) U.S. Cl.
CPC ..... *H01R 13/2421* (2013.01); *H01R 13/24* (2013.01); *H01R 13/428* (2013.01);
(Continued)

(58) Field of Classification Search
CPC ..... H01R 13/2421; H01R 13/428; H01R 13/502; H01R 13/518; H01R 13/631
(Continued)

(56) References Cited

U.S. PATENT DOCUMENTS 9,350,105 B2 * 5/2016 Kim ..... B23K 33/002
2007/0049063 A1 3/2007 Endo
(Continued)

FOREIGN PATENT DOCUMENTS

JP 2002-8754 1/2002
JP 2007-66887 3/2007
(Continued)

OTHER PUBLICATIONS

International Search Report dated Sep. 12, 2017.

*Primary Examiner* — Abdullah A Riyami
*Assistant Examiner* — Nader J Alhawamdeh
(74) *Attorney, Agent, or Firm* — Gerald E. Hespos; Michael J. Porco; Matthew T. Hespos

(57) ABSTRACT

A terminal module (10) includes an electrical contact member (11) having a coil holding surface (12F) configured to face a contact surface (62F) provided on a mating terminal (61), a conductive obliquely wound coil spring (21) and a holder (31) configured to hold the obliquely wound coil spring (21) by being assembled with the electrical contact member (11). The holder (31) includes a holder body (32)
(Continued)

configured to hold the obliquely wound coil spring (21) along the coil holding surface (12F) and having a window portion (35) configured to expose the obliquely wound coil spring (21) toward a side opposite to the coil holding surface (12F), and locking pieces (39) continuous from the holder body (32) and configured to engage the electrical contact member (11).

5 Claims, 22 Drawing Sheets

(51) Int. Cl.
*H01R 13/631* (2006.01)
*H01R 13/428* (2006.01)
*H01R 13/502* (2006.01)

(52) U.S. Cl.
CPC ..... *H01R 13/502* (2013.01); *H01R 13/518* (2013.01); *H01R 13/631* (2013.01)

(58) Field of Classification Search
USPC ..... 439/700
See application file for complete search history.

(56) References Cited

U.S. PATENT DOCUMENTS

| | | | | |
|---|---|---|---|---|
| 2013/0130556 | A1* | 5/2013 | Blakborn | H01R 13/187 439/626 |
| 2013/0330981 | A1 | 12/2013 | Blakborn | |
| 2015/0255903 | A1* | 9/2015 | Fujii | H01R 12/714 439/889 |
| 2016/0181714 | A1 | 6/2016 | Chawla et al. | |
| 2019/0103695 | A1* | 4/2019 | Kimura | H01R 13/2421 |

FOREIGN PATENT DOCUMENTS

| | | |
|---|---|---|
| JP | 2008-204634 | 9/2008 |
| JP | 2012-248495 | 12/2012 |
| JP | 2013-535777 | 9/2013 |
| JP | 2014-510371 | 4/2014 |
| JP | 2016-46156 | 4/2016 |

* cited by examiner

TERMINAL MODULE WITH A CONDUCTIVE OBLIQUELY WOUND COIL SPRING HELD AGAINST AN ELECTRICAL CONTACT MEMBER AND CONNECTOR HAVING SUCH A TERMINAL MODULE

BACKGROUND

Field of the Invention

This specification relates to a terminal module and a connector.

Related Art

Japanese Unexamined Patent Publication No. 2008-204634 discloses a contact device in which two conductors are connected electrically using a coil spring in an energizing part of an electrical device. This contact device includes a spring contact (obliquely wound coil spring) formed by spirally winding a wire into a state inclined with respect to a winding axis, and two conductors fittable to each other. A groove into which the spring contact is to be fit is provided in a fitting surface of one of the two conductors. When the two conductors are fit, the spring contact is sandwiched between the two conductors to connect the two conductors electrically.

In the above configuration, it is necessary to provide the groove in the conductor by cutting and weld both ends of the spring contact to the conductors. Therefore, a configuration and a manufacturing process tend to be complicated.

SUMMARY

A terminal module disclosed in this specification includes an electrical contact member having a coil holding surface configured to face a contact surface provided on a mating terminal, a conductive obliquely wound coil spring, and a holder configured to hold the obliquely wound coil spring by being assembled with the electrical contact member. The holder includes a holder body configured to hold the obliquely wound coil spring along the coil holding surface and including an opening configured to expose the obliquely wound coil spring toward a side opposite to the coil holding surface. An engaging portion is continuous from the holder body and is configured to engage the electrical contact member.

Further, a connector disclosed in this specification includes the terminal module configured as described above.

According to the above configurations, the obliquely wound coil spring is sandwiched between and connects the mating terminal and the electrical contact member when the mating terminal and the electrical contact member are brought close. Thus, the coil spring can be held on the electrical contact member by a simple configuration and a manufacturing process can be simplified.

In the above configuration, the holder body may be displaceable in directions toward and away from the coil holding surface. More particularly, the obliquely wound coil spring has a nonlinear region where a spring load hardly changes even if a height (dimension in a direction perpendicular to a coil axis) of the spring is changed. In this nonlinear region, even if the height of the obliquely wound coil spring changes due to assembling tolerances, vibration during use and the like, a spring load hardly changes. Thus, by making the holder displaceable, the assembling tolerances can be absorbed effectively utilizing this nonlinear region and without affecting electrical connection between the electrical contact member and the mating terminal. Further, an influence on contact resistance due to a movement of the mating terminal can be suppressed.

The holder may include a displacement restricting portion configured to restrict a displacement of the holder body in the direction toward the coil holding surface by butting against the coil holding surface. According to this configuration, it is possible to avoid excessive squeezing of the obliquely wound coil spring and plastic deformation of the obliquely wound coil spring such as when an impact is applied to the connector.

The engaging portion may include a deflecting piece extending from the holder body and deflectable in a direction intersecting an extending direction from the holder body and a locking projection projecting from the deflecting piece and configured to lock the electrical contact member. Additionally, the connector housing may include a deflection restricting wall configured to restrict the deflection of the deflecting piece in a direction to be disengaged from the electrical contact member by interfering the deflecting piece. According to this configuration, even if an external force is applied to the holder during a connecting operation of the connector to a mating connector and during the use of the connector, inadvertent detachment of the holder from the electrical contact member can be avoided.

According to the terminal module and the connector disclosed in this specification, the obliquely wound coil spring can be held by a simple configuration and a simple manufacturing process.

DETAILED DESCRIPTION

Figure 9:
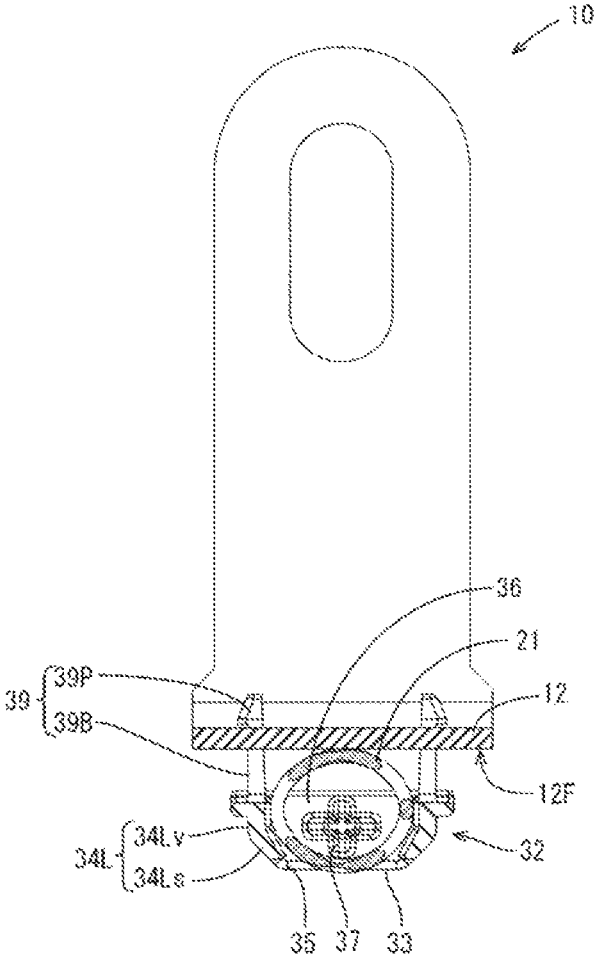
FIG. 9 is a section along B-B of FIG. 7.
Figure 10:
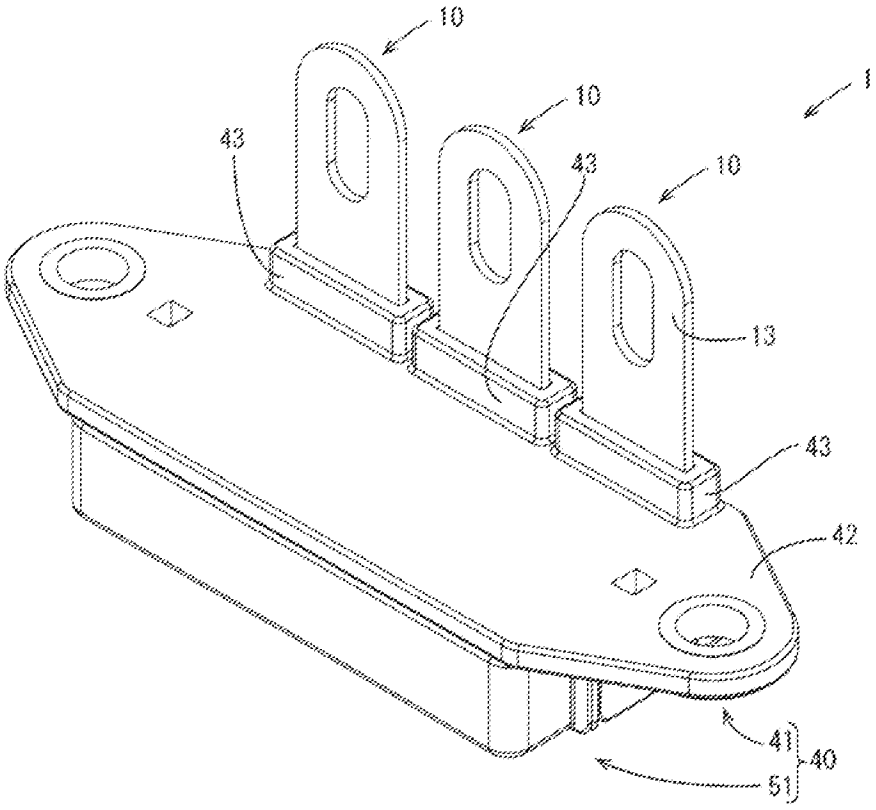
FIG. 10 is a perspective view 1 of a connector.

An embodiment is described with reference to FIGS. 1 to 22. A connector 1 of this embodiment includes three terminal modules 10 and a connector housing 40 configured to hold these terminal modules 10 and to be connected to a mating connector 60 as shown in FIG. 10.

Figure 1:
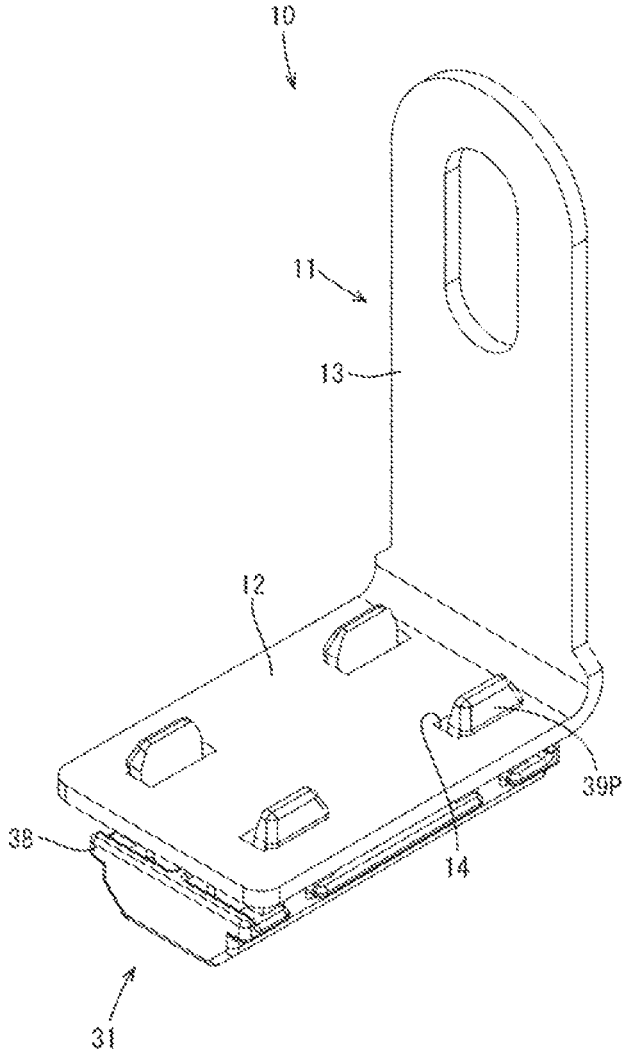
FIG. 1 is a perspective view 1 of a terminal module of an embodiment.
Figure 2:
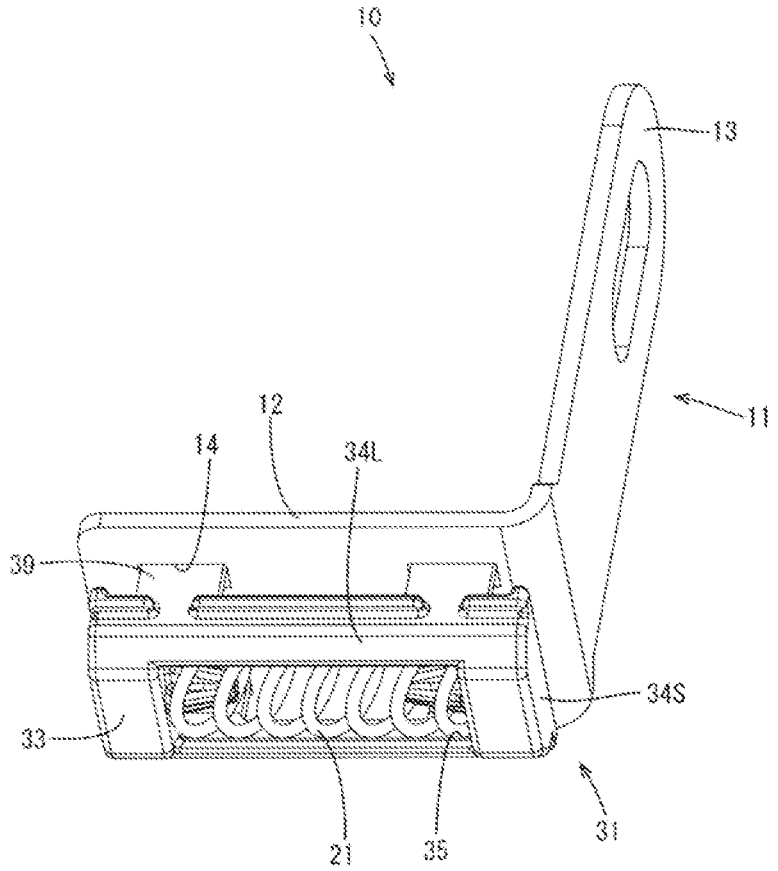
FIG. 2 is a perspective view 2 of the terminal module.
Figure 3:
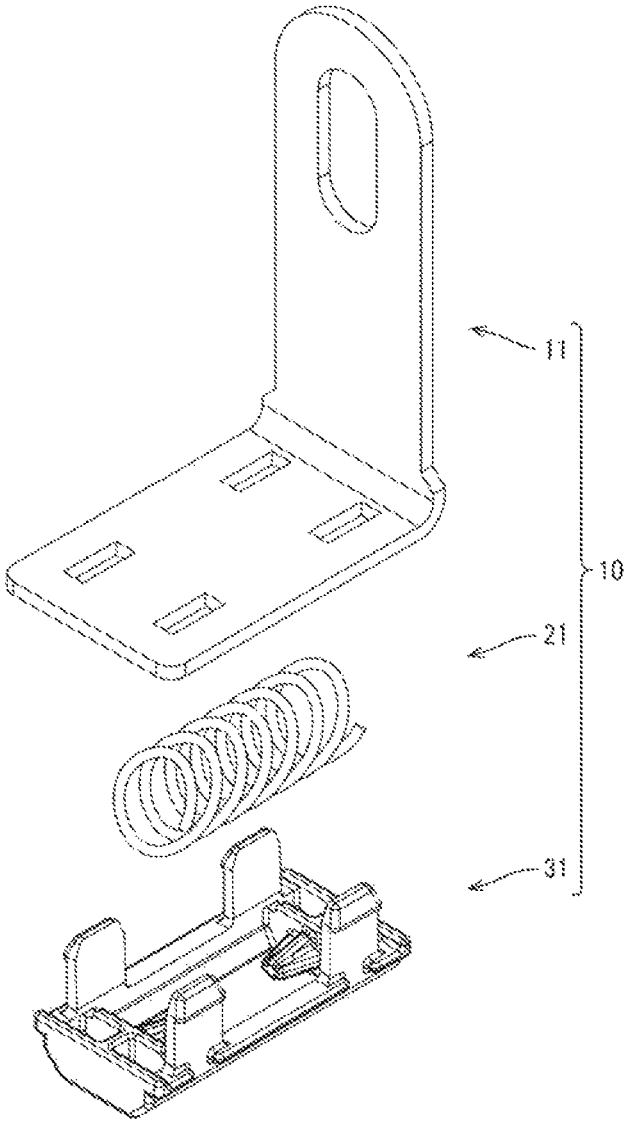
FIG. 3 is an exploded perspective view of the terminal module.

As shown in FIGS. 1, 2 and 3, each of the three terminal modules 10 includes an electrical contact member 11, a conductive obliquely wound coil spring 21 and a holder 31 configured to hold the obliquely wound coil spring 21 by being assembled with the electrical contact member 11.

Figure 4:
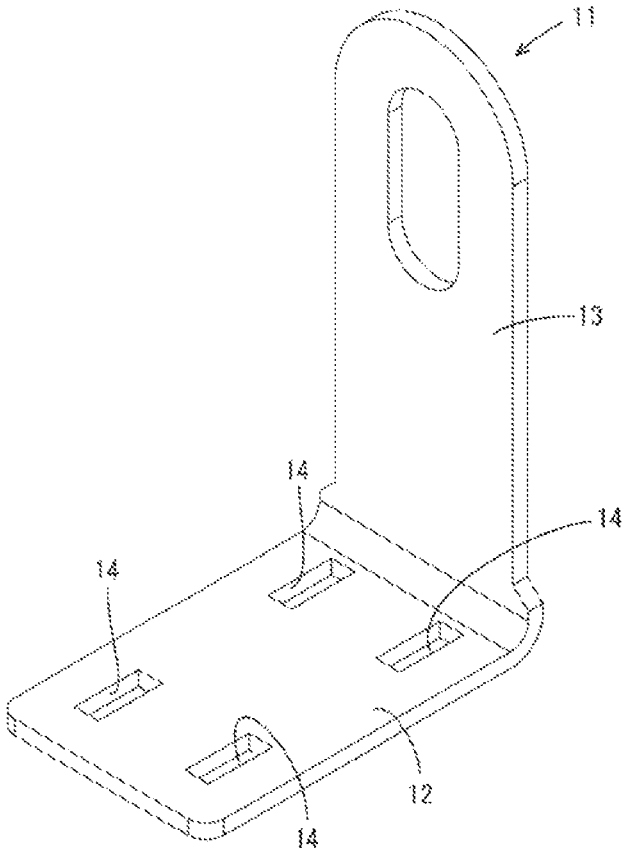
FIG. 4 is a perspective view of an electrical contact member.

The electrical contact member 11 is an L-shaped plate-like member formed by press-working a plate member made of a conductive material such as copper alloy and includes, as shown in FIG. 4, a terminal connecting portion 21 in the form of an elongated plate and an external connecting portion 13 in the form of an elongated plate extending perpendicular to the terminal connecting portion 12. One surface (surface opposite to a side toward which the external connecting portion 13 extends; lower surface of FIG. 6) of the terminal connecting portion 12 serves as a coil holding surface 12F. The terminal connecting portion 12 includes four locking holes 14 for locking the holder 31. Each locking hole 14 is a through hole penetrating from the coil holding surface 12F of the terminal connecting portion 12 to a surface opposite to the coil holding surface 12F.

Figure 8:
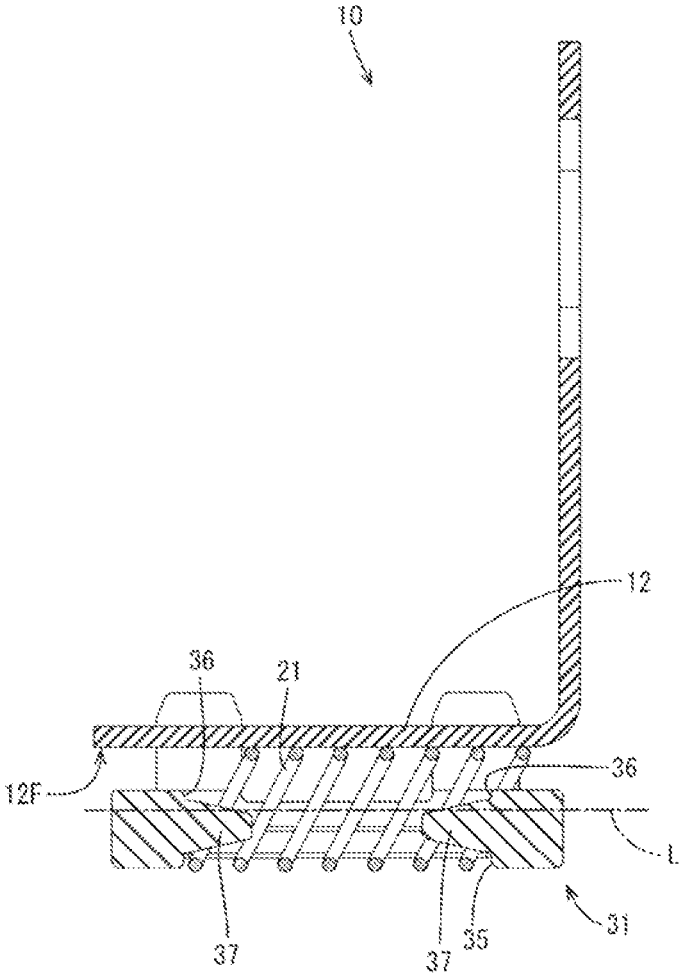
FIG. 8 is a section along A-A of FIG. 6.

As shown in FIG. 3, the obliquely wound coil spring 21 is a coil spring formed by winding a conductive wire a plurality of times. As shown in FIG. 8, the obliquely wound coil spring 21 is a spring in which a winding wire constituting the spring is wound to be inclined in one direction with respect to a coil axis L, unlike a general coil spring. This obliquely wound coil spring 21 is deformed to make a height (dimension in a direction perpendicular to the coil axis L) of the spring smaller by the winding wire tilting to be further inclined with respect to the coil axis L when a load is applied to an outer peripheral part of the obliquely wound coil spring 21 in a direction perpendicular to the coil axis L. The obliquely wound coil spring 21 has a nonlinear region where a spring load hardly changes even if a displacement amount (displacement of the height) thereof is changed.

As shown in FIG. 8, this obliquely wound coil spring 21 is arranged on the coil holding surface 12F in such a posture that the coil axis L is substantially parallel to the coil holding surface 12F, and held by the holder 31.

Figure 5:
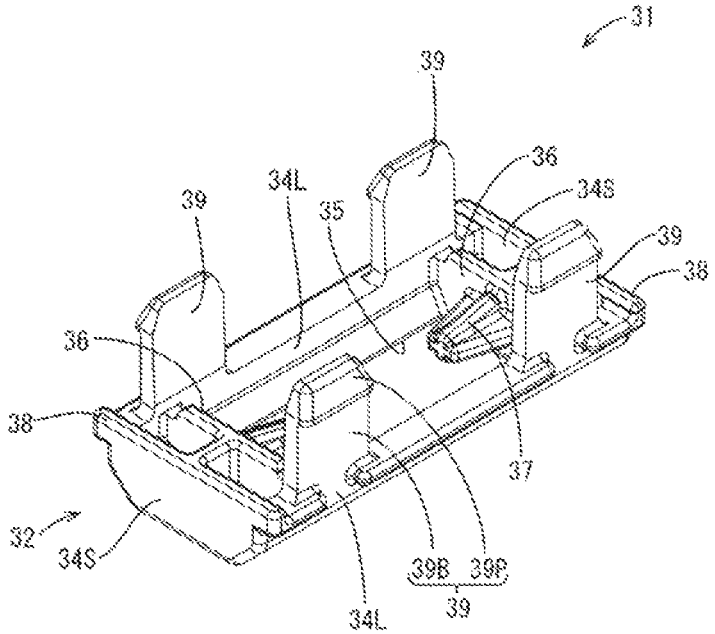
FIG. 5 is a perspective view of a holder.

As shown in FIG. 5, the holder 31 includes a holder body 32 configured to hold the obliquely wound coil spring 21, a pair of holding walls 36 and a pair of holding shafts 37 arranged inside the holder body 32, four locking pieces 39 (equivalent to an engaging portion) continuous from the holder body 32 and configured to engage the terminal connecting portion 12, and a displacement restricting portion 38 continuous from the holder body 32.

Figure 6:
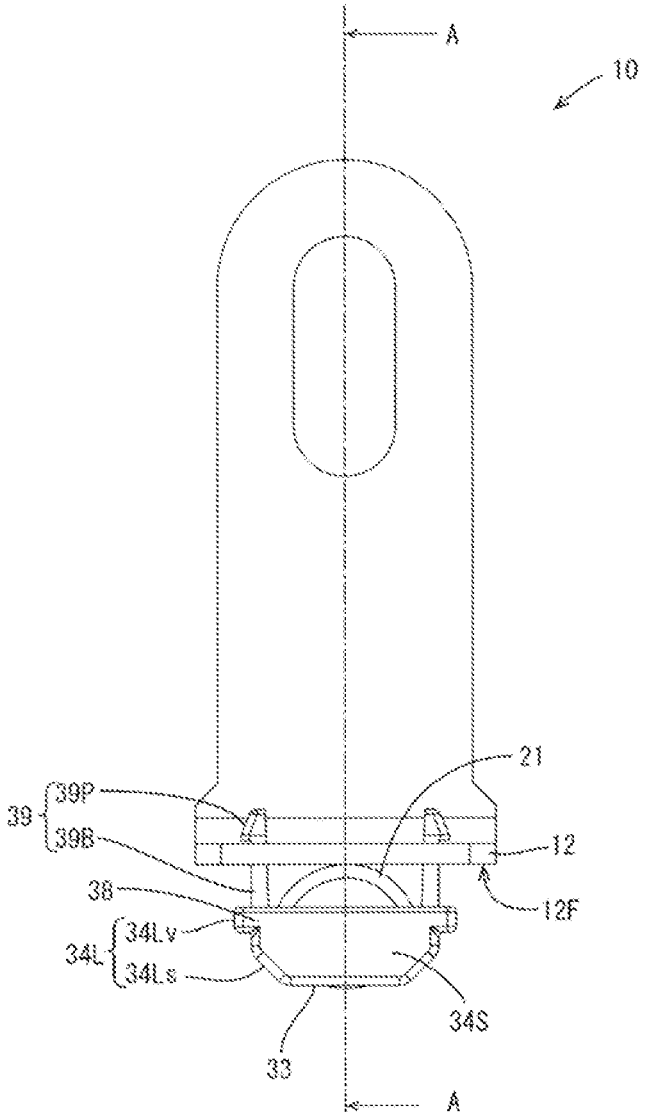
FIG. 6 is a front view of the terminal module.
Figure 7:
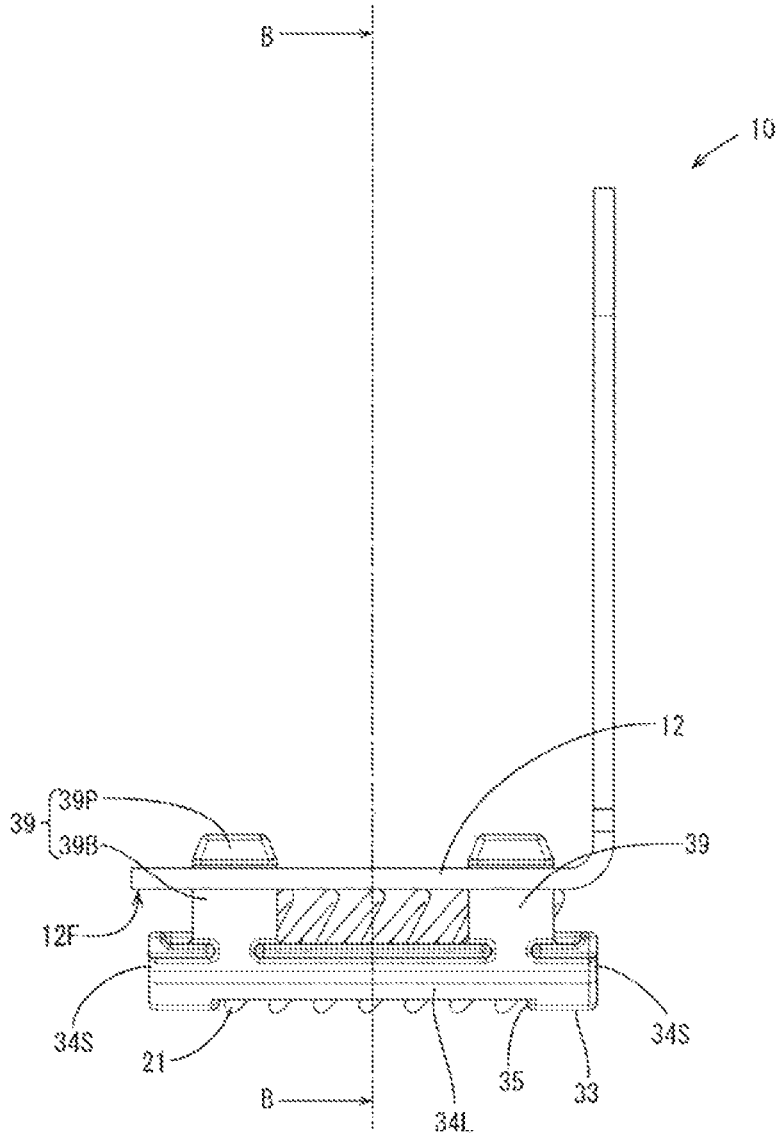
FIG. 7 is a side view of the terminal module.

As shown in FIG. 5, the holder body 32 is a tray-like part long in one direction and includes a bottom wall portion 33 and a pair of long side walls 34L and a pair of short side walls 34S extending from this bottom wall portion 33. As shown in FIG. 2, the bottom wall portion 33 is a rectangular plate-like part. Each of the pair of long side walls 34L is a wall portion extending from each of a pair of long sides of the bottom wall portion 33 and includes, as shown in FIGS. 6 and 9, an inclined portion 34Ls extending from the bottom wall portion 33 and inclined outward (in a direction away from the mating long side wall 34L) with distance from the bottom wall portion 33, and a vertical portion 34Lv extending from an extending end of the inclined portion 34Ls perpendicularly to the bottom wall portion 33. As shown in FIGS. 2 and 7, each of the pair of short side walls 34S is a wall portion extending perpendicular to the bottom wall portion 33 and both side edges thereof are respectively connected to the pair of long side walls 34L.

Each of the holding walls 36 is a wall portion arranged parallel to the short side wall 34S with a clearance defined therebetween as shown in FIG. 5.

Each of the holding shafts 37 is a shaft portion for holding the obliquely wound coil spring 21. As shown in FIGS. 5 and 8, each holding shaft 37 is a cross-shaped part extending inward (toward the mating holding wall 36) from the corresponding one of the pair of holding walls 36.

The bottom wall portion 33 includes a window portion 35 (equivalent to an opening). As shown in FIGS. 2 and 5, the window portion 35 is an opening formed by a region enclosed by the pair of long sides and the pair of holding walls 36 in the bottom wall portion 33 and penetrating from one surface side to the other surface side.

As shown in FIG. 5, two locking pieces 39 extend from one of the pair of long side walls 34L and two locking pieces 39 extend from the other long side wall 34L. Each locking piece 39 includes a deflecting piece 39B in the form of a plate piece extending from an extending end of the long side wall 34L in a direction opposite to the bottom wall portion 33, and a locking projection 39P projecting in a direction perpendicular to the deflecting piece 39B. The locking pieces 39 arranged on the one long side wall 34L and those arranged on the other long side wall 34L face each other, and each locking projection 39P projects on an outer side surface of each locking piece 39 (toward a side opposite to the facing other locking piece 39).

As shown in FIG. 5, the displacement restricting portions 38 are flange-like parts extending from the pair of short side walls 34S in directions opposite to the bottom wall portion 33 and extending laterally outward (in directions perpendicular to the long side walls 34L).

The obliquely wound coil spring 21 is accommodated inside the holder 31 and held not to come off the holder 31 by having the pair of holding shafts 37 inserted inside as shown in FIG. 8. An interval between the pair of holding walls 36 is set somewhat shorter than a length of the obliquely wound coil spring 21 in a free state where no load is applied, and the obliquely wound coil spring 21 is held in a state somewhat compressed in a direction along the coil axis L.

As shown in FIG. 9, the obliquely wound coil spring 21 has an elliptical shape when viewed in an axial direction and is disposed such that a minor axis of the elliptical shape extends in a direction perpendicular to the bottom wall portion 33. As shown in FIG. 9, a width (distance between a pair of hole edges extending in a direction along the long sides of the bottom wall portion 33) of the window portion 35 is somewhat shorter than a major axis of the elliptical shape of the obliquely wound coil spring 21, and the obliquely wound coil spring 21 is held in contact with an inner wall surface of the holder body 32 while partially slightly projecting outward through the window portion 35.

As shown in FIGS. 6 to 9, the holder 31 is assembled with the terminal connecting portion 12 in such an orientation that the holder body 32 faces the coil holding surface 12F. The deflecting pieces 39B of the four locking pieces 39 are respectively inserted into the four locking holes 14 and the locking projections 39P are locked to peripheral edge parts of the locking holes 14 in the terminal connecting portion 12, whereby the holder 31 is held not to be detached from the terminal connecting portion 12 (see also FIG. 21). In assembling the holder 31 with the terminal connecting portion 12, each locking projection 39P is inserted into the locking hole 14 while each deflecting piece 39B is deflected inward (side opposite to the side where the locking projection 39P is located). When the locking projection 39P passes through the locking hole 14, the deflecting piece 39B resiliently returns and the locking projection 39P is locked to the peripheral edge part of the locking hole 14 in the terminal connecting portion 12.

A distance from a base end of the deflecting piece 39B (end edge connected to the holder body 32) to the locking projection 39P is longer than a thickness of the terminal connecting portion 12, and the deflecting piece 39B is displaceable in a direction perpendicular to the terminal connecting portion 12 between a position where the locking projections 39P butt against the terminal connecting portion 12 (position shown in FIGS. 6 to 9) and a position where the displacement restricting portions 38 butt against the terminal connecting portion 12 (position shown in FIGS. 13 to 16). As the deflecting pieces 39B are displaced, the holder body 32 is displaceable in a direction (vertical direction of FIG. 6) toward or away from the coil holding surface 12F.

With the holder 31 assembled with the terminal connecting portion 12, the obliquely wound coil spring 21 is in contact with the coil holding surface 12F and sandwiched by the holder body 32 and the terminal connecting portion 12. In a state where no pressing force is applied to the holder 31, the holder 31 is held at the position where the locking projections 39P butt against the terminal connecting portion 12 (position where the holder body 32 is most distant from the terminal connecting portion 12; position shown in FIG. 6) by a resilient force of the obliquely wound coil spring 21.

As shown in FIG. 10, the connector housing 40 is configured by assembling an upper divided body 41 and a lower divided body 51 made of synthetic resin.

The upper divided body 41 includes a mounting plate 42 in the form of a flat plate and three terminal receiving portions 44 projecting from one surface (lower surface of FIG. 18) of both front and back surfaces of the mounting plate 42.

Three insertion holes (not shown) through which the external connecting portions 13 are insertable are provided side by side in the mounting plate 42 and, as shown in FIG. 10, insertion tubes 43 into which the external connecting portions 13 are insertable rise from hole edges of the respective insertion holes perpendicularly to the mounting plate 42.

Figure 18:
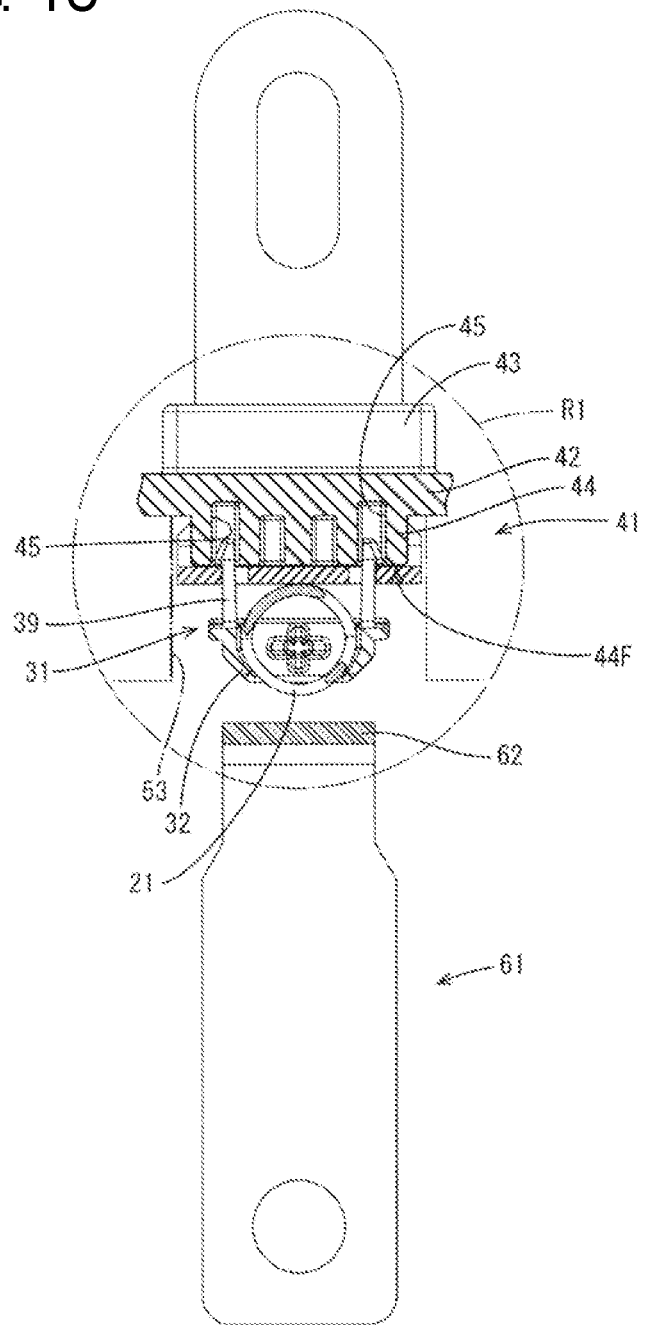
FIG. 18 is a partial enlarged section showing a state before the connector and the mating connector are connected.

As shown in FIG. 18, the respective three terminal receiving portions 44 are flat block-like parts rising from a surface of the mounting plate 42 opposite to the surface where the insertion tubes 43 are arranged, and provided adjacent to the respective three insertion holes. Each terminal receiving portion 44 includes a terminal contact surface 44F parallel to the mounting plate 42.

Figure 21:
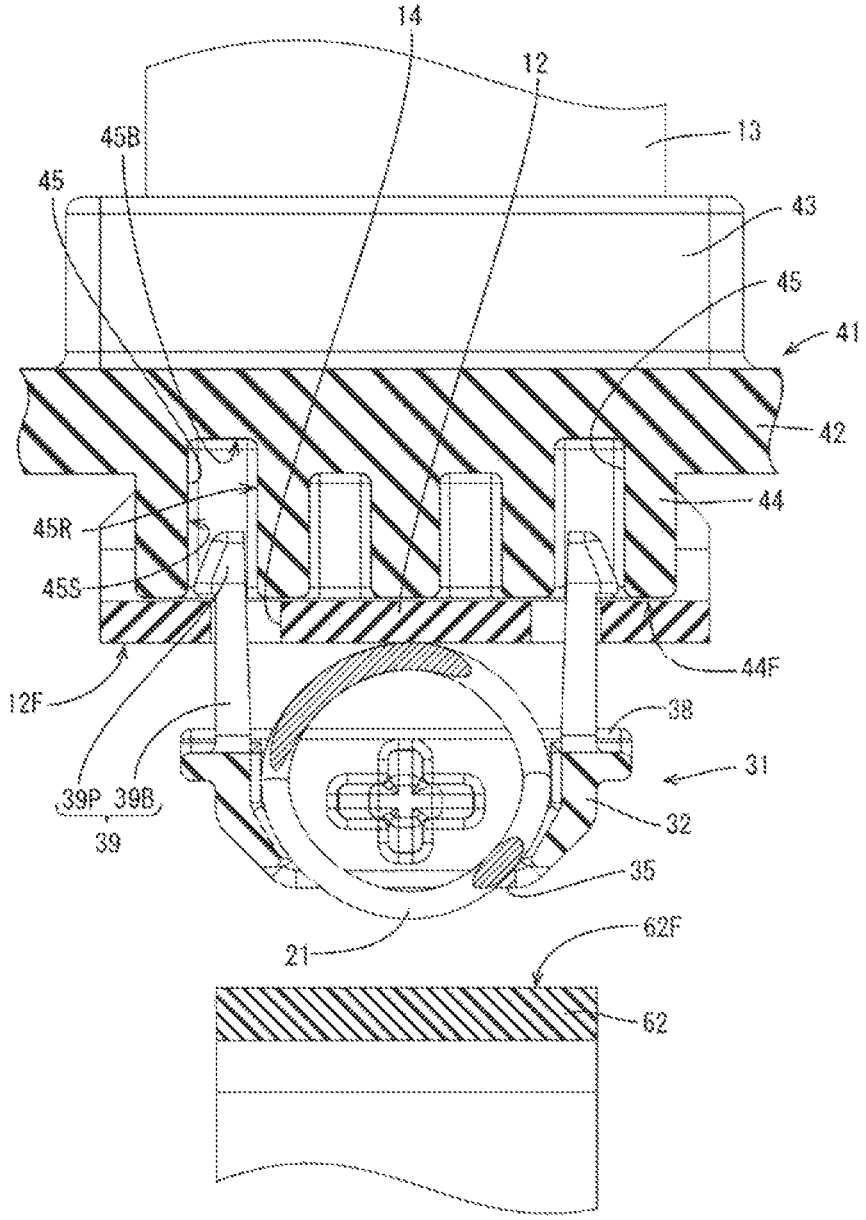
FIG. 21 is an enlarged view of the inside of a circle R1 of FIG. 18.
Figure 22:
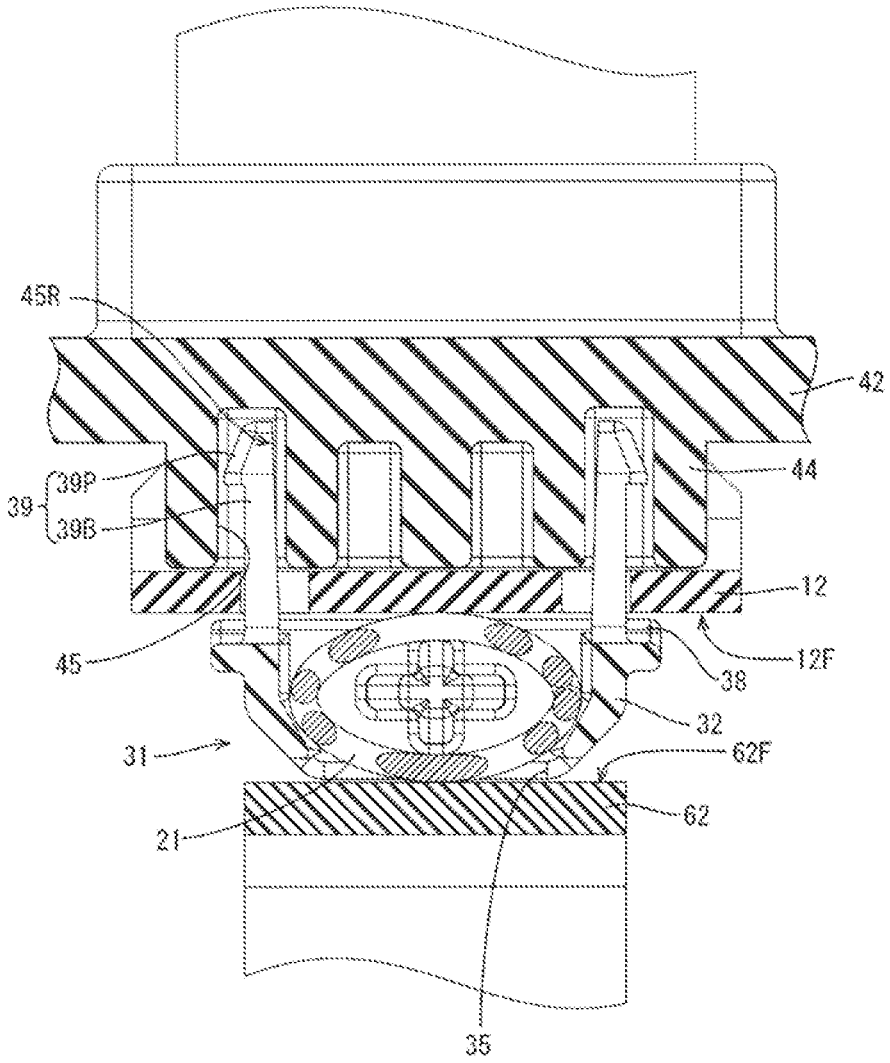
FIG. 22 is an enlarged view of the inside of a circle R2 of FIG. 20.

Each terminal receiving portion 44 includes four accommodation grooves 45 for respectively receiving the four locking pieces 39. Each of the four accommodation grooves 45 is a groove recessed toward the mounting plate 42 from the terminal contact surface 44F and is a groove defined by a groove bottom wall 45B parallel to the terminal contact surface 44F and two groove-side walls (deflection restricting wall 45R and facing wall 45S) extending to the terminal contact surface 44F perpendicularly from the groove bottom wall 45B and arranged to face each other with a clearance formed therebetween as shown in FIG. 21.

Figure 11:
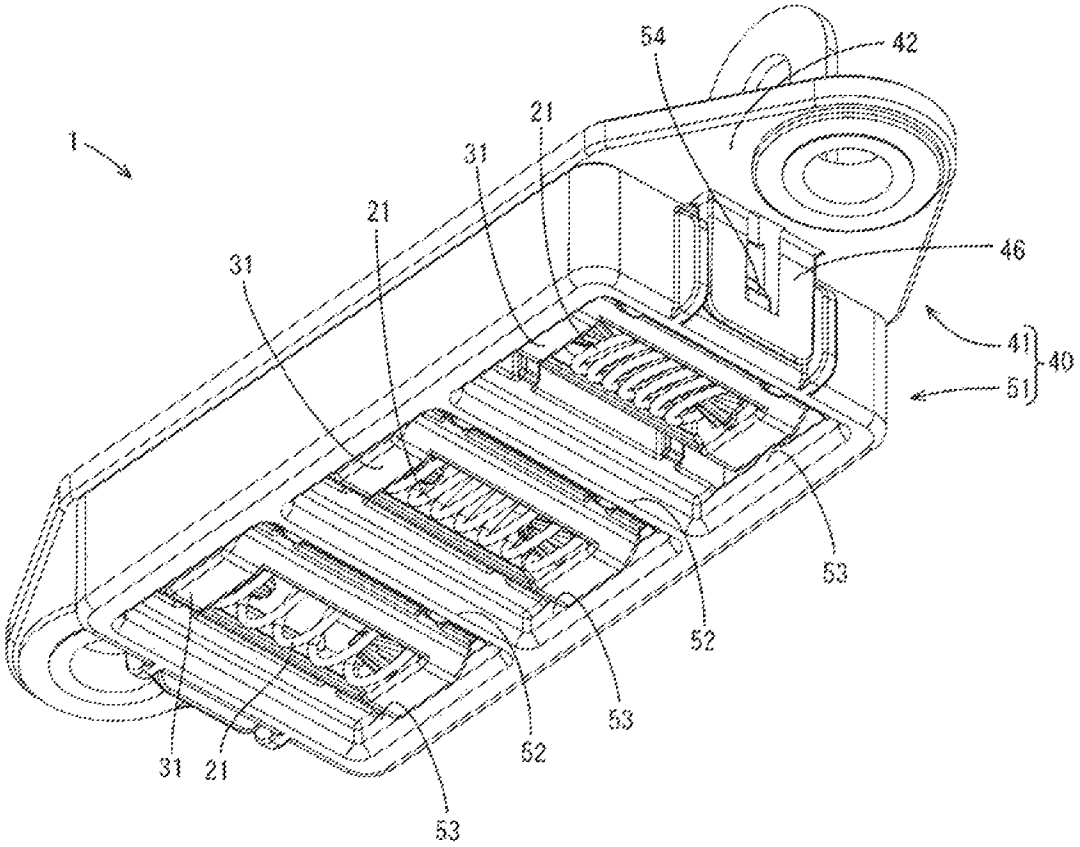
FIG. 11 is a perspective view 2 of the connector.

The lower divided body 51 is a flat rectangular tube-like member open on both ends. An internal space of the lower divided body 51 is divided into three holder accommodation chambers 53 by two partition walls 52 as shown in FIG. 11. This lower divided body 51 is assembled with the upper divided body 41 such that one opening edge of the lower divided body 51 is in contact with the surface of the mounting plate 42 where the terminal receiving portions 44 are arranged, and held inseparably from the upper divided body 41 by engaging lock pieces 46 extending from the mounting plate 42 with lock projections 54 arranged on an outer wall surface of the lower divided body 51.

In assembling the terminal modules 10 with the connector housing 40, three terminal modules 10 are first assembled with the upper divided body 41. The external connecting portion 13 of each terminal module 10 is inserted through the insertion hole and the insertion tube 43 to bring the terminal connecting portion 12 into contact with the terminal contact surface 44F. Tip parts of the four locking pieces 39 projecting from the terminal connecting portion 12 are respectively accommodated into the four accommodation grooves 45 as shown in FIGS. 18 and 21. The deflection restricting walls 45R are arranged to face inner surfaces (surfaces opposite to those from which the locking projections 39P project) of the locking pieces 39 without almost any clearance formed therebetween, thereby restricting inward (direction to unlock the locking projections 39P from the terminal connecting portion 12) deflection of the locking pieces 39.

Subsequently, the lower divided body 51 is assembled with the upper divided body 41, thereby holding the terminal modules 10. The respective three terminal receiving portions 44 and the holder bodies 32 and the obliquely wound coil springs 21 of the respective three terminal modules 10 are accommodated into the three holder accommodation chambers 53 (see FIG. 18).

Figure 12:
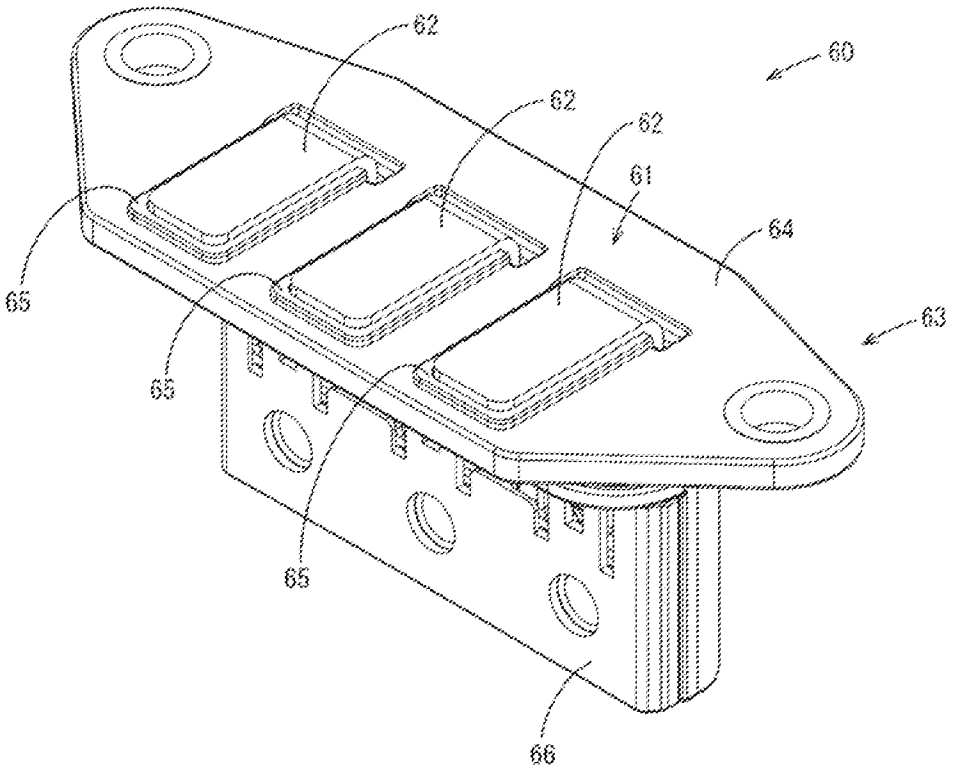
FIG. 12 is a perspective view of a mating connector.

As shown in FIG. 12, the mating connector 60 includes three mating terminals 61 to be connected to the electrical contact members 11 via the obliquely wound coil springs 21 and a mating connector housing 63 for holding these mating terminals 61.

Figure 13:
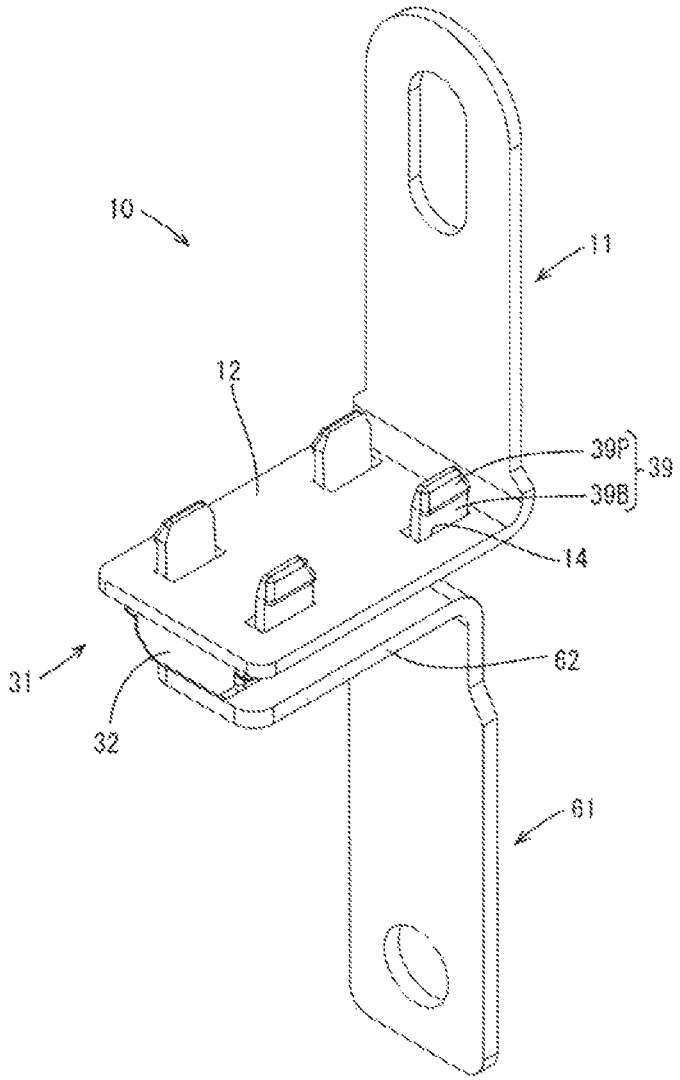
FIG. 13 is a perspective view showing a state where the terminal module and a mating terminal are connected.
Figure 14:
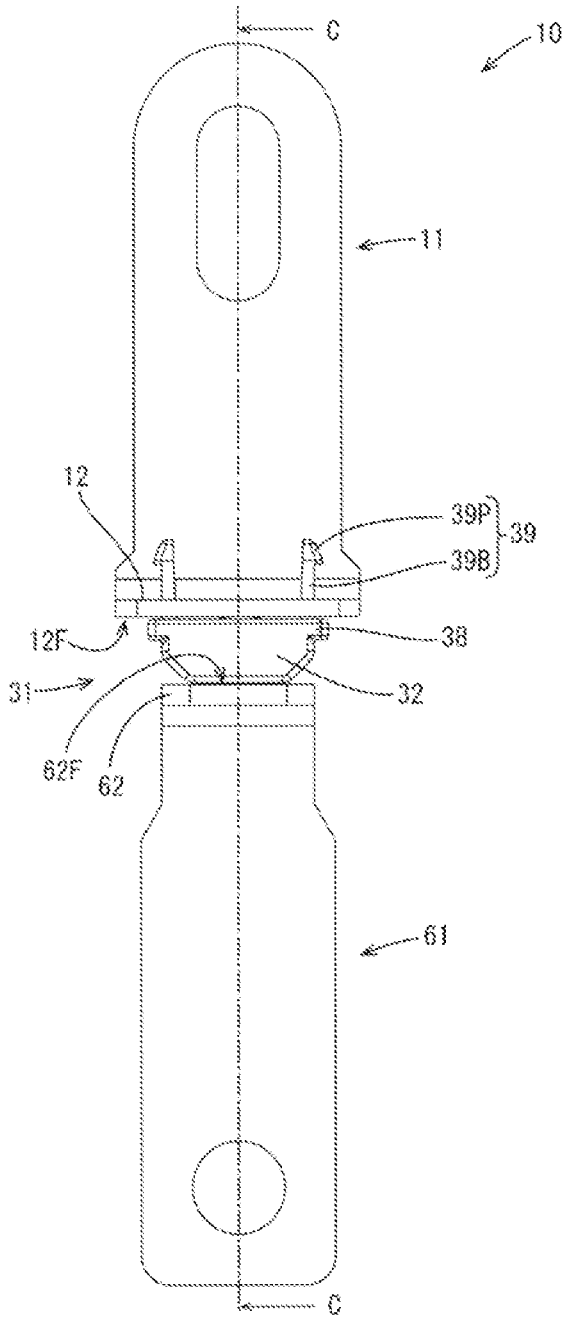
FIG. 14 is a front view showing the state where the terminal module and the mating terminal are connected.
Figure 15:
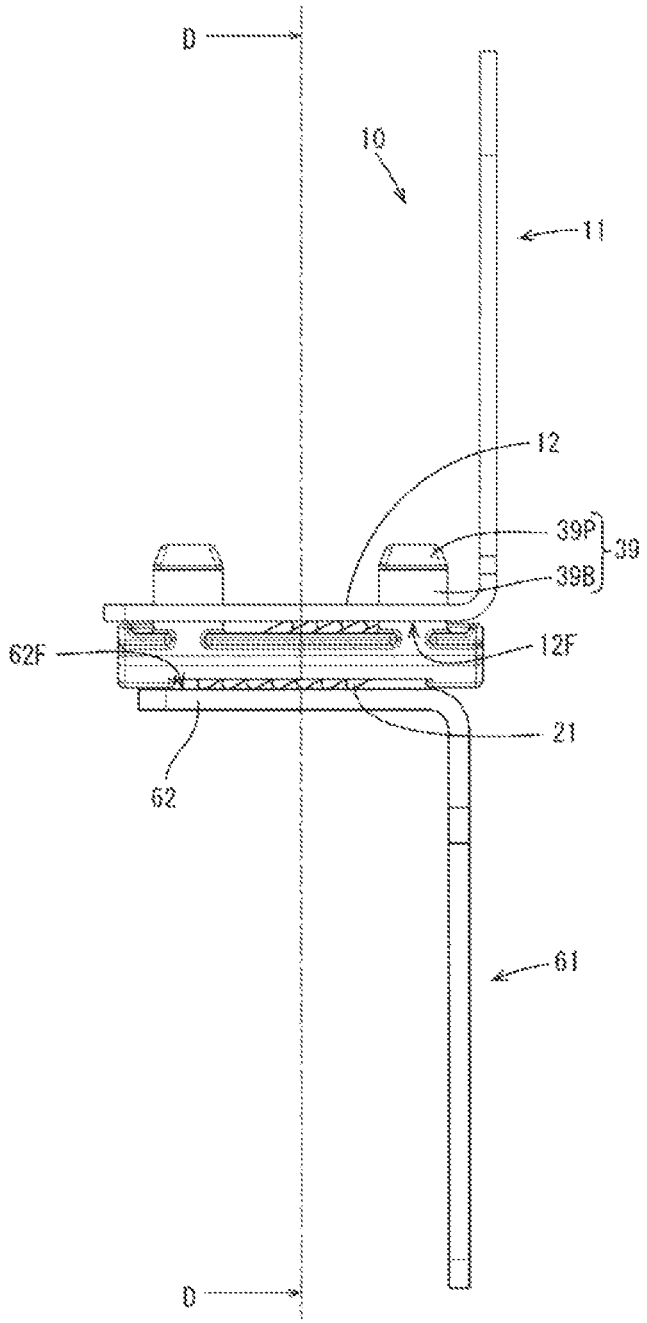
FIG. 15 is a side view showing the state where the terminal module and the mating terminal are connected.

As shown in FIG. 13, each of the three mating terminals 61 is an L-shaped busbar formed by bending an elongated plate member made of a conductive material into an L shape, and one side of the L shape serves as a contact portion 62 in the form of an elongated plate.

The mating connector housing 63 is made of synthetic resin and integrally formed with the three mating terminals 61 by insert molding. As shown in FIG. 12, this mating connector housing 63 includes a plate-like mating mounting plate 64 having substantially the same outer shape as the mounting plate 42 of the connector housing 40, three terminal blocks 65 arranged side by side on one of both front and back surfaces of the mating mounting plate 64 and a terminal holding portion 66 extending from the other surface of the mating mounting plate 64.

Figure 16:
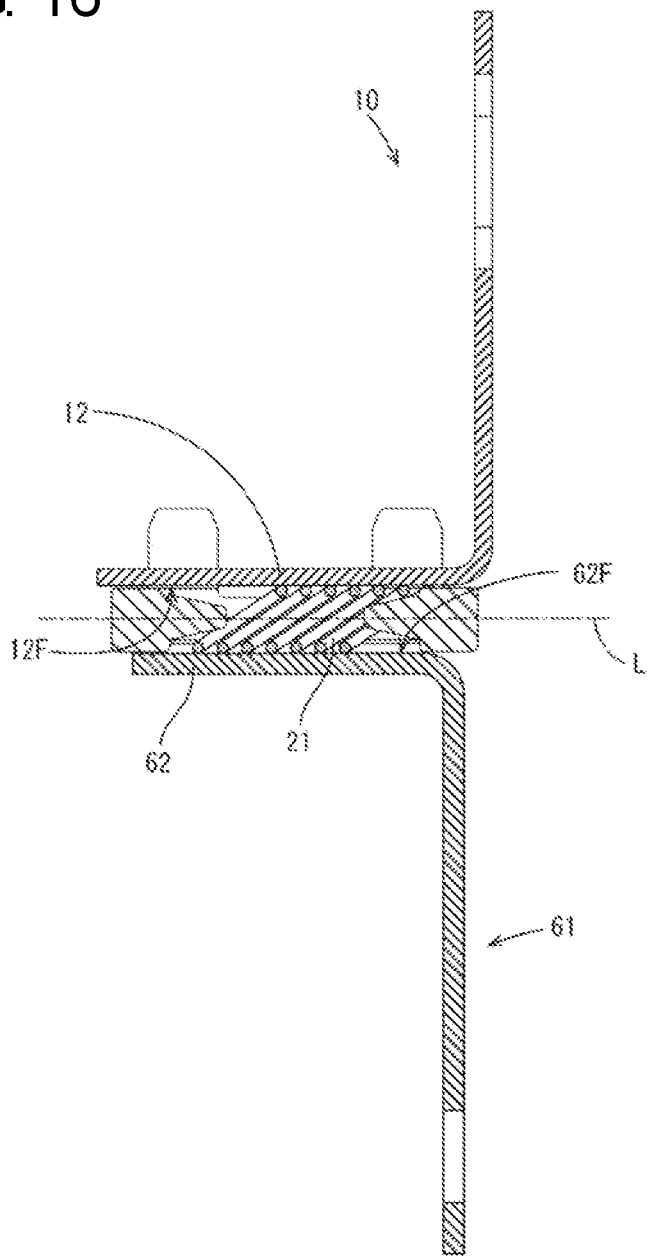
FIG. 16 is a section along C-C of FIG. 14.
Figure 17:
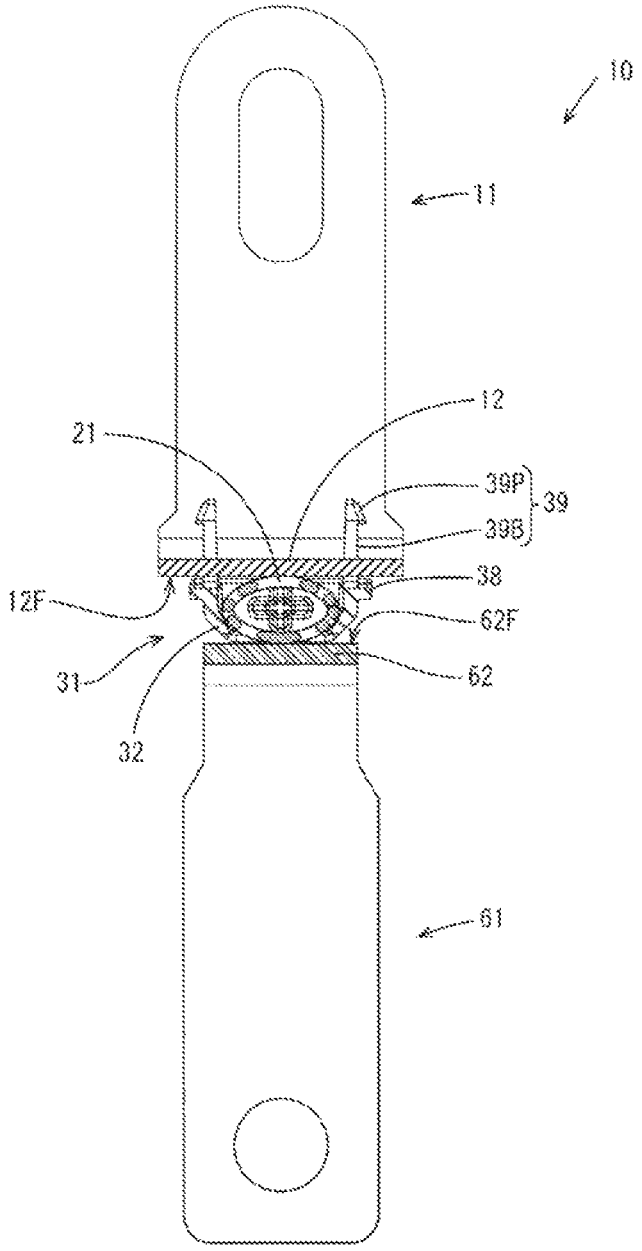
FIG. 17 is a section along D-D of FIG. 15.

Each of the three terminal blocks 65 is a rectangular block having a short height and projecting from the mating mounting plate 64, and the contact portion 62 of the corresponding one of the three mating terminals 61 is placed on the terminal block 65. In the contact portion 62, a surface opposite to the terminal block 65 serves as a contact surface 62F to be brought into contact with the obliquely wound coil spring 21 when the connector 1 and the mating connector 60 are assembled as shown in FIG. 16. The terminal holding portion 66 is block-shaped and the other side part of the L shape of each of the three mating terminals 61 is embedded in the terminal holding portion 66.

Figure 19:
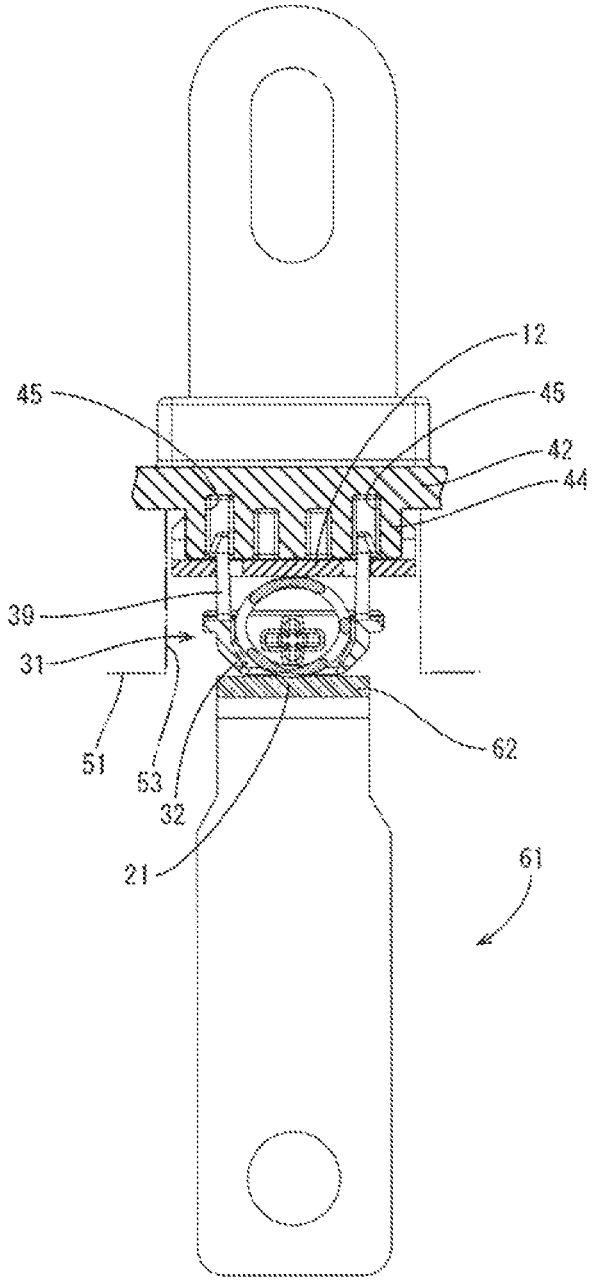
FIG. 19 is a partial enlarged section showing a state while the connector and the mating connector are being connected.
Figure 20:
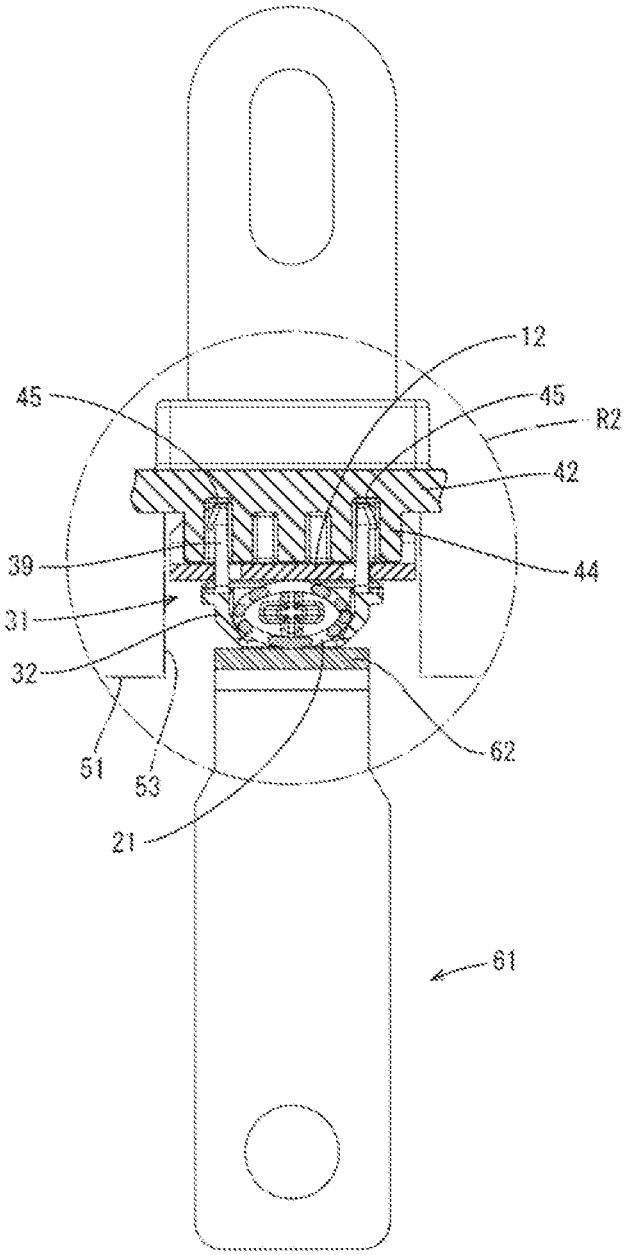
FIG. 20 is a partial enlarged section showing a state when the connection of the connector and the mating connector is completed.

In assembling the connector 1 with the mating connector 60, the three terminal blocks 65 and the three contact portions 62 of the mating connector 60 are respectively inserted into the three holder accommodation chambers 53, and the contact portions 62 contact parts of the obliquely wound coil springs 21 projecting from the window portions 35 as shown in FIG. 19. Then, the mating terminals 61 and the electrical contact members 11 are electrically connected via the obliquely wound coil springs 21. At this time, the electrical contact members 11 and the mating terminals 61 contact the obliquely wound coil springs 21 at many points, whereby many contact points can be ensured and contact resistance can be reduced. Note that the mating connector housing 63 is not shown in FIGS. 18 to 20 in consideration of the viewability of drawings. Further, the mating connector housing 63 and the lower divided body 51 are not shown in FIGS. 21 and 22.

When the connector 1 and the mating connector 60 are brought even closer to bring the contact portions 62 and the terminal connecting portions 12 closer in this connected state, the contact portions 62 come into contact with the bottom wall portions 33 while pushing the obliquely wound coil springs 21 into the holder bodies 32 through the window portions 35. As the contact portions 62 and the terminal connecting portions 12 are brought even closer, the contact portions 62 press the bottom wall portions 33 and the holder bodies 32 are displaced toward the terminal connecting portions 12. Associated with this, the obliquely wound coil springs 21 are deformed to further tilt the winding wires with respect to the coil axes L against resilient forces thereof (see FIG. 16). Then, the obliquely wound coil springs 21 resiliently contact the electrical contact members 11 and the mating terminals 61 due to the resilient forces thereof. In this way, the reliability of electrical connection of the electrical contact members 11 and the mating terminals 61 is ensured.

With the connector 1 and the mating connector 60 completely connected, the obliquely wound coil springs 21 are used in the nonlinear regions. In this nonlinear region, even if a height of the obliquely wound coil spring 21 changes due to a change in relative distance between the contact portion 62 and the terminal connecting portion 12 caused by assembling tolerances of the connector 1 and the mating connector 60, vibration and the like, a spring load hardly changes. Thus, the assembling tolerances of the connector 1 and the mating connector 60 can be absorbed without affecting electrical connection. Further, an influence on contact resistance due to a movement of the mating terminal 61 can be suppressed.

Note that the holder body 32 is stopped at a position where the displacement restricting portions 38 butt against the coil holding surface 12F, thereby preventing the obliquely wound coil spring 21 from being excessively squeezed. In this way, plastic deformation of the obliquely wound coil spring 21 such as when an impact is applied to the connector 1 can be avoided.

As described above, according to this embodiment, the terminal module 10 includes the electrical contact member 11 having the coil holding surface 12F configured to face the contact surface 62F provided on the mating terminal 61, the conductive obliquely wound coil spring 21 and the holder 31 configured to hold the obliquely wound coil spring 21. The holder 31 includes the holder body 32 and the locking pieces 39. The holder body 32 is a part for holding the obliquely wound coil spring 21 along the coil holding surface 12F and includes the window portion 35 configured to expose the obliquely wound coil spring 21 toward the side opposite to the coil holding surface 12F. The locking pieces 39 are pars continuous from the holder body 32 and configured to engage the electrical contact member 11.

According to the above configuration, the obliquely wound coil spring 21 to be sandwiched between the mating terminal 61 and the electrical contact member 11 to connect the both when the mating terminal 61 and the electrical contact member 11 are brought closer can be held on the electrical contact member 11 by a simple configuration and a manufacturing process can be simplified.

Further, the holder body 32 is displaceable in the directions toward and away from the coil holding surface 12F.

Here, the obliquely wound coil spring 21 has the nonlinear region where a spring load hardly changes even if the height (dimension in the direction perpendicular to the coil axis L) of the spring is changed. In this nonlinear region, even if the height of the obliquely wound coil spring 21 changes due to a change in relative distance between the contact portion 62 and the terminal connecting portion 12 caused by the assembling tolerances of the connector 1 and the mating connector 60, vibration during use and the like, a spring load hardly changes. Thus, by making the holder body 32 displaceable, the assembling tolerances of the connector 1 and the mating connector 60 can be absorbed effectively utilizing this nonlinear region and without affecting electrical connection between the electrical contact member 11 and the mating terminal 61. Further, an influence on contact resistance due to a movement of the mating terminal 61 can be suppressed.

Further, the holder 31 includes the displacement restricting portions 38 configured to restrict a displacement of the holder body 32 in the direction toward the coil holding surface 12F by butting against the coil holding surface 12F.

According to the above configuration, it is possible to avoid excessive squeezing of the obliquely wound coil spring 21 and plastic deformation of the obliquely wound coil spring 21 such as when an impact is applied to the connector 1.

In addition, the locking piece 39 includes the deflecting piece 39B extending from the holder body 32 and deflectable in a direction intersecting an extending direction from the holder body 32 and the locking projection 39P projecting from the deflecting piece 39B and configured to lock the electrical contact member 11, and the connector housing 40 includes the deflection restricting walls 45R configured to restrict the deflection of the deflecting pieces 39B in a direction to be disengaged from the electrical contact member 11 by interfering with the deflecting pieces 39B.

According to the above configuration, inadvertent detachment of the holder 31 from the electrical contact member 11 can be avoided even if an external force is applied to the holder 31 during a connecting operation of the connector 1 to the mating connector 60 and during the use of the connector 1.

The invention is not limited to the above described and illustrated embodiment. For example, the following various modes also are included.

Although the holder 31 is made of synthetic resin in the above embodiment, a holder may be made of a conductive material such as metal.

Although the holder body 32 of the holder 31 is displaceable toward or away from the coil holding surface 12F in the above embodiment, a holder may not be displaceable.

The number of the terminal modules 10 held in the connector housing 40 is not limited to that of the above embodiment and may be two or less or four or more.

LIST OF REFERENCE SINGS

1 . . . connector
10 . . . terminal module
11 . . . electrical contact member
12F . . . coil holding surface
21 . . . obliquely wound coil spring
31 . . . holder
32 . . . holder body
35 . . . window portion (opening)
38 . . . displacement restricting portion
39 . . . locking piece (engaging portion)
39B . . . deflecting piece
39P . . . locking projection
40 . . . connector housing
45R . . . deflection restricting wall
51 . . . mating terminal
52 . . . contact surface

The invention claimed is:

1. A terminal module, comprising:

an electrical contact member having a coil holding surface configured to face a contact surface provided on a mating terminal;

a conductive obliquely wound coil spring having an external spring surface positioned against the coil holding surface; and a holder;

the holder including:

a holder body opposed to the coil holding surface of the electrical contact member and configured to hold the external spring surface of the obliquely wound coil spring against the coil holding surface, the holder body including an opening configured to expose a side of the obliquely wound coil spring that is opposite to the coil holding surface;

an engaging portion projecting from the holder body and configured to engage the electrical contact member; and the engaging portion and the electrical contact member are configured so that the holder body is displaceable in directions toward and away from the coil holding surface.

2. The terminal module of claim 1, wherein the holder includes a displacement restricting portion configured to restrict a displacement of the holder body in the direction toward the coil holding surface by butting against the coil holding surface.

3. A connector, comprising:

the terminal module of claim 1; and a connector housing configured to hold the terminal module.

4. The connector of claim 3, wherein:

the engaging portion includes a deflecting piece extending from the holder body and deflectable in a direction intersecting an extending direction from the holder body and a locking projection projecting from the deflecting piece and configured to lock the electrical contact member; and the connector housing includes a deflection restricting wall configured to restrict the deflection of the deflecting piece in a direction to be disengaged from the electrical contact member by interfering the deflecting piece.

5. The terminal module of claim 1 wherein the electrical contact member has a locking hole and the engaging portion projecting from the holder body being movably engaged in the locking hole.

* * * * *